US006899330B1

(12) United States Patent
Zink

(10) Patent No.: US 6,899,330 B1
(45) Date of Patent: May 31, 2005

(54) BOWLING DICE GAME

(76) Inventor: Fredrick I. Zink, 33441 Hathaway, Livonia, MI (US) 48150

( * ) Notice: Subject to any disclaimer, the term of this patent is extended or adjusted under 35 U.S.C. 154(b) by 0 days.

(21) Appl. No.: 10/816,598

(22) Filed: Apr. 5, 2004

(51) Int. Cl.[7] ..... A63F 9/04
(52) U.S. Cl. ..... 273/146; 272/277
(58) Field of Search ..... 273/146, 277

(56) References Cited

U.S. PATENT DOCUMENTS 2,148,102 A 2/1939 Brumer
2,148,412 A * 2/1939 Frank ..... 62/224
3,892,410 A * 7/1975 Hoetzel ..... 273/145 C
3,905,603 A * 9/1975 Hoetzel ..... 273/145 C
4,436,306 A * 3/1984 Sanders ..... 273/146
4,989,875 A * 2/1991 Capy et al. ..... 273/146
5,082,288 A * 1/1992 Swartz ..... 273/244
5,342,059 A * 8/1994 Briem et al. ..... 273/277
5,511,782 A * 4/1996 Maley ..... 473/569
5,688,126 A * 11/1997 Merritt ..... 434/128
5,791,649 A * 8/1998 DiSandro ..... 273/243
5,833,237 A * 11/1998 Velich ..... 273/146
5,909,874 A * 6/1999 Daniel et al. ..... 273/146
5,938,197 A * 8/1999 Bowling ..... 273/143 A
6,123,332 A * 9/2000 Bowling ..... 273/138.1
6,209,870 B1 * 4/2001 Shea et al. ..... 273/146
6,234,482 B1 * 5/2001 Henderson ..... 273/274
6,318,720 B1 * 11/2001 Bowling ..... 273/138.1

* cited by examiner

*Primary Examiner*—Gregory Vidovich
*Assistant Examiner*—Dolores Collins
(74) *Attorney, Agent, or Firm*—Charles W. Chandler

(57) ABSTRACT

A game in which a pair of dice are rolled and a score is kept according to the rules of bowling.

1 Claim, 1 Drawing Sheet

BOWLING DICE GAME

BACKGROUND OF THE INVENTION

This invention is related to a dice game in which a pair of dice are individually rolled onto a surface for simulating a bowling game.

Dice are employed in a variety of games for simulating the play of athletic games. For example, U.S. Pat. No. 2,148,102, which issued to John J. Brumer, Feb. 21, 1939, discloses a bowling dice game in which ten dice are rolled onto a flat surface. Each die has the image of a pin on one of its surfaces. The dice are rolled and the score kept in accordance with the rules of bowling.

SUMMARY OF THE INVENTION

The broad purpose of the present invention is to provide an improved bowling dice game which employs two dice. Preferably one die is green, and the other red. The green die has five faces with indicia designating the numbers one to five, respectively. The sixth face has an "X" representing a strike. The second, red die has four faces with indicia designating the numbers one to four, respectively, a fifth face with an "/" designating a spare, and a sixth face with a "G" designating a gutter ball.

The dice are individually rolled with the red die being rolled depending upon the outcome of the green die. For example, if the player rolling the green die rolls a strike, he marks the score sheet and passes the dice to the second player. If the green die designates a different score, then the player rolls the red die. The score is kept basically in accordance with conventional bowling rules.

Still further objects and advantages of the invention will become readily apparent to those skilled in the art to which the invention pertains upon reference to the following detailed description.

DESCRIPTION OF THE DRAWINGS

The description refers to the accompanying drawing in which like reference characters refer to like parts throughout the several views, and in which.

DESCRIPTION OF THE PREFERRED EMBODIMENT

Figure 1:
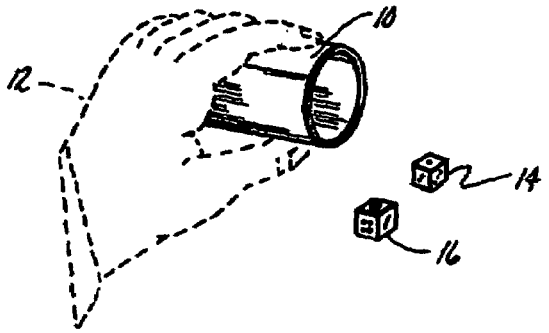
FIG. 1 is a view of a player with a cup rolling a die illustrating the invention and in accordance with the rules of bowling.

Referring to the drawings, FIG. 1 illustrates dice cup 10 employed by user 12 rolling a pair of dice 14 and 16.

Figure 2:
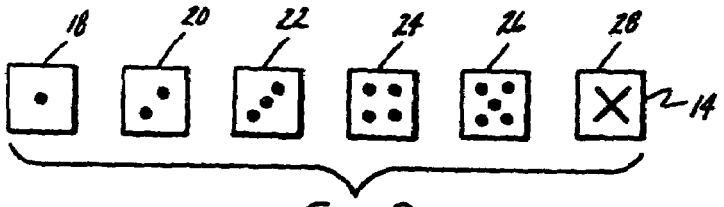
FIG. 2 is a series of views illustrating the six faces of the first die.
Figure 3:
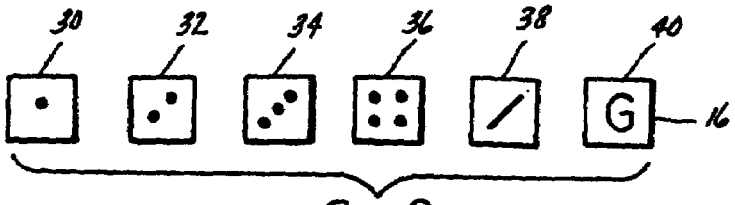
FIG. 3 is a series of views illustrating the six faces of the second die.
Figure 4:
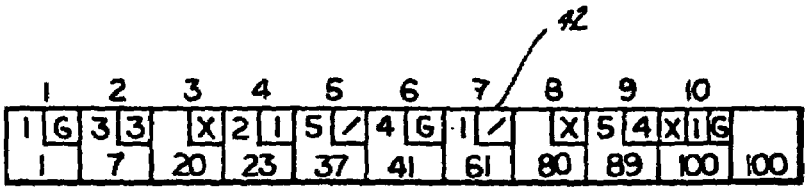
FIG. 4 is a view of a score sheet illustrating a typical game.

Die 14 has six faces illustrated in sequence in FIG. 2. Faces 18, 20, 22, 24 and 26 have spots representing the numbers one to five, respectively, while the sixth face 28 has an "X" representing a strike.

Die 14 is preferably green in color.

Die 16 is red and has six faces numbered 30, 32, 34, and 36 which have spots representing the numbers 1 to 4, respectively. A fifth face 38 has a "/" representing a spare, and the sixth face 40 has a "G" representing a gutter ball.

The object of the game is to roll a high score in accordance with the scoring rules of bowling. A low score can also be played if desired.

To start the play, the first player rolls green die 14. If face 28, designating a strike, is rolled face-up, the appropriate mark is made on score sheet 42. The player then passes the dice to the second player. If, on the other hand, die 14 is rolled with either face 18, 20, 22, 24 or 26 face-up, he then enters the appropriate score on the score sheet, rolls the red die to complete his score for the frame, marks the score sheet and then passes the dice to the next player. If the player rolls the red die such that face 38 appears face-up, he enters the appropriate mark on the score sheet to represent a spare and then passes the dice to the next player.

Scoring is generally in accordance with the conventional rules of bowling. If a player does not roll a strike or spare, he adds the numbers of the two rolls, enters the score and the frame is complete. If the player rolls a strike, then that player's next two rolls are added to the strike which are counted as ten points. If the player rolls a spare, then that player's next roll is added to the spare which is counted as ten points.

Thus, it is to be understood that I have described an improved dice game in which the score is kept in accordance with the rules of bowling.

Having described my invention, I claim:

1. A method for playing a dice game comprising the steps of:

rolling a first die having five faces with indicia designating 1, 2, 3, 4 and 5, respectively, and a sixth face having indicia representing a strike;

if the face having the strike indicia is rolled face-up, entering a score on a score sheet and passing the dice to the second player;

if the first die is rolled such that the face having the indicia designated 1, 2, 3, 4 or 5 is rolled face-up, rolling a second die, having four faces with indicia designating 1, 2, 3 and 4, respectively, a fifth face with indicia designating a spare, and a sixth face with indicia designating a gutter ball;

if the face of the second die with indicia designates a spare, is rolled face-up, entering a mark of the roll on the score sheet and then passing the dice to another player; and if the face with indicia designating 1, 2, 3, 4 or gutter is rolled face-up, enter the score of the roll on the score sheet, completing the score on the score sheet for the frame and passing the dice to another player, and repeating this procedure between the players until the game is completed.

* * * * *